US007624983B2

(12) United States Patent
Häusler

(10) Patent No.: US 7,624,983 B2
(45) Date of Patent: Dec. 1, 2009

(54) DEVICE AND METHOD FOR STACKING SHEETS

(75) Inventor: August Häusler, Wolfratshausen (DE)

(73) Assignee: Giesecke & Devrient GmbH, München (DE)

( * ) Notice: Subject to any disclaimer, the term of this patent is extended or adjusted under 35 U.S.C. 154(b) by 81 days.

(21) Appl. No.: 11/596,008

(22) PCT Filed: May 9, 2005

(86) PCT No.: PCT/EP2005/005012

§ 371 (c)(1),
(2), (4) Date: Nov. 19, 2007

(87) PCT Pub. No.: WO2005/110904

PCT Pub. Date: Nov. 24, 2005

(65) Prior Publication Data

US 2008/0185777 A1 Aug. 7, 2008

(30) Foreign Application Priority Data

May 11, 2004 (DE) ..... 10 2004 023 312

(51) Int. Cl.
*B65H 29/20* (2006.01)

(52) U.S. Cl. ..... 271/315; 271/218; 271/314

(58) Field of Classification Search ..... 271/314, 271/315, 218
See application file for complete search history.

(56) References Cited

U.S. PATENT DOCUMENTS 3,162,438 A 12/1964 Perry, Jr.
3,285,607 A * 11/1966 Lindemann ..... 271/218
3,298,683 A * 1/1967 Stroud ..... 271/218
4,139,191 A * 2/1979 Muller ..... 271/189
4,436,472 A * 3/1984 Kunzmann ..... 414/790.8
4,501,418 A 2/1985 Ariga et al.
4,517,451 A 5/1985 Kokubo et al.

(Continued)

FOREIGN PATENT DOCUMENTS

DE 1 248 561 8/1967

(Continued)

OTHER PUBLICATIONS

Search Report of German Patent Office dated Jul. 18, 2005 regarding German Patent Application 10 2004 023 312.8.

(Continued)

*Primary Examiner*—Patrick H Mackey
*Assistant Examiner*—Prasad V Gokhale
(74) *Attorney, Agent, or Firm*—Bacon & Thomas, PLLC

(57) ABSTRACT

A spiral slot stacker (1) has a stacker wheel (4) for accommodating sheet material (6, 7, 8), a stripper (2) for stripping off the accommodated sheet material (6, 7, 8) and a stack deposit (9) for stacking the stripped-off sheet material (6, 7, 8). The stacker (2) is movable and in a first position strips off the sheet material (6, 7, 8) from the stacker wheel (4) in such a manner that it is intermediately stacked between the stacker wheel circumference and a guideway (3). When the stripper (2) is moved to a second position, it stacks the intermediately stacked sheet material (7) on the stack deposit (9), and subsequent sheet material (6, 7, 8) is directly stacked on the stack deposit without intermediate stacking.

18 Claims, 8 Drawing Sheets

U.S. PATENT DOCUMENTS

| | | | | |
|---|---|---|---|---|
| 4,629,174 | A | 12/1986 | Wakisaka et al. | |
| 4,861,019 | A * | 8/1989 | Michalik | 271/315 |
| 5,123,638 | A | 6/1992 | Mutou | |
| 5,630,584 | A * | 5/1997 | Seeber | 271/315 |
| 5,894,937 | A * | 4/1999 | Schmidt | 209/534 |
| 6,019,209 | A * | 2/2000 | Hara et al. | 194/206 |
| 6,131,903 | A * | 10/2000 | Schaefer et al. | 271/312 |
| 6,398,107 | B1 | 6/2002 | Neri | |
| 6,464,218 | B2 * | 10/2002 | Neary et al. | 271/270 |
| 2001/0042958 | A1 * | 11/2001 | Kishine et al. | 271/315 |
| 2003/0082044 | A1 * | 5/2003 | Gendron et al. | 414/789.9 |
| 2004/0135398 | A1 | 7/2004 | Booher | |
| 2005/0023746 | A1 * | 2/2005 | Michler et al. | 271/187 |
| 2005/0253322 | A1 | 11/2005 | Leuthold | |

FOREIGN PATENT DOCUMENTS

| | | |
|---|---|---|
| DE | 2 311 581 | 9/1973 |
| DE | 34 20 336 | 12/1984 |
| DE | 40 15 217 | 11/1990 |
| DE | 44 37 722 | 4/1996 |
| DE | 199 55 782 | 7/2000 |
| DE | 101 21 835 | 11/2002 |
| DE | 102 34 970 | 2/2004 |
| EP | 0 059 101 | 9/1982 |
| EP | 0 119 814 | 9/1984 |
| EP | 0 121 409 | 10/1984 |
| EP | 0 955 259 | 11/1999 |
| EP | 1 155 993 | 11/2001 |
| GB | 1 422 593 | 1/1976 |
| JP | 58-113067 | 7/1983 |

OTHER PUBLICATIONS

International Search Report in PCT/EP2005/005012, dated Jan. 18, 2006.

* cited by examiner

DEVICE AND METHOD FOR STACKING SHEETS

FIELD OF THE INVENTION

The present invention relates to a method for stacking sheet material as well as a spiral slot stacker for stacking sheet material, in particular for the use in a bank note processing apparatus.

BACKGROUND

In conventional bank note processing apparatus the bank notes are generally singled from a stack and led past a sensor device by means of a transport path. The individual bank notes are checked by sensors of the sensor device and dependent on the checking result are supplied to certain final destinations or stacker units. Accordingly, several stacker units can be available, which stack the bank notes of the different categories into units of an adjustable piece number. If for example bank notes of a certain category are to be stacked in units of a piece number of 100 bank notes, it is necessary to perform a separation in the continuous flow of bank notes between the one hundredth bank note and the following bank note meant for the same stacker after the one hundredth bank note has arrived at the stacker.

In this context EP 0 119 814 B1 describes a spiral slot stacker for paper sheets, wherein the singled paper sheets are fed via a supply unit into slots of a stacker wheel, with a stack deposit, in which the paper sheets, which are stripped off from the stacker wheel by means of a fixed stripper, are stacked. Furthermore the spiral slot stacker comprises swiveling separators on which, when in an accommodation position in which they are fixed above the stack deposit, paper sheets which are stripped off from the stacker wheel are stacked intermediately. When the separators are subsequently swiveled out of the accommodation position, the intermediately stacked bank notes collide with the fixed stripper, are stripped off and stacked on the stack deposit. The use of the separators enables the separation of the paper sheets supplied to the spiral slot stacker into units of a predetermined piece number by removing paper sheets which are stacked on the stack deposit and intermediately stacking the subsequent paper sheets on the separators. However, at high transport speeds the secure function of the spiral slot stacker cannot be guaranteed, since relatively great actuating forces have to be applied in order to accelerate the separators.

Instead of the use of separators the published patent application DE 102 34 970 A1 suggests to intermediately stack bank notes in the stacker wheel of a spiral slot stacker. If for example the bank notes supplied to the spiral slot stacker are to be separated into units of 100 bank notes each on a stack deposit, after the one hundredth bank note was stripped off from the stacker wheel the bank notes can be intermediately stacked in the slots of the stacker wheel for such a time until the stack deposit has been emptied. Therein, a stripper for stripping the bank notes comprises two movable components, i.e. a first part which is moved out of the strip-off position during the intermediate stacking procedure, and a second part which is rotated along with the rotating stacker wheel during the intermediate stacking procedure.

In a first embodiment, the second part of the stripper rotates along with the stacker wheel for such a time until the stack deposit is prepared to accommodate a next bank-note stack and the second part of the stripper again has reached its strip-off position in which it is then fixed. The bank notes accommodated in the stacker wheel are thus stripped off and stacked on the stack deposit. Then the first part of the stripper can be moved back to its strip-off position, too. This embodiment bears the risk of the collision of the bank note and the second part of the stripper, which temporarily rotates along with the stacker wheel, during the insertion of the bank note into the stacker wheel.

In a second embodiment, like in the first embodiment, the first part of the stripper is moved out of the strip-off position and the second part is moved along with the stacker wheel while the stack deposit is emptied. However, the second, rotating-along part of the stripper is subsequently brought back to its strip-off position against the rotation direction of the stacker wheel and is fixed in order to strip the bank notes off from the stacker wheel. In this case the stack deposit has to be prepared very quickly for the accommodation of the next stack of bank notes to be stacked, since the second part of the stripper otherwise moves too far away from the stack deposit and the bank notes would no longer be reliably stacked on the stack deposit during the return of the stripper. In order to avoid this problem, in the published patent application DE 102 34 970 A1 therefore again the use of an auxiliary stack deposit or separator is suggested in order to intermediately stack the bank notes stripped off from the stacker wheel while the proper stack deposit is emptied.

SUMMARY

It is therefore the object of the present invention to provide an alternative solution for the intermediate stacking of sheet material in a spiral slot stacker.

A spiral slot stacker for stacking sheet material according to the invention comprises a stacker wheel, a movable stripper and a stack deposit. Singled sheet material is supplied to the stacker wheel in such a manner that it is accommodated in slots of the stacker wheel, which are spirally disposed one after another around a rotation axis. The stacker wheel turns so that the slots are filled with sheet material. Therein it is also possible that the slots of the stacker wheel accommodate several sheets. By means of the stripper the sheet material is stripped off from the slots of the stacker wheel.

In order to secure a continuous stacking of the sheet material in units of an adjustable piece number of sheets on the stack deposit without the necessity of stopping or buffering the supply of the sheet material to the stacker wheel, stopping the stacker wheel or introducing a separator for the intermediate stacking of the sheet material, the spiral slot stacker according to the present invention comprises a guideway which surrounds the stacker wheel at least partially and which is preferably adapted to the round shape of the stacker wheel circumference. If the stripper is in a first position, the sheet material accommodated in the slots is stripped off from the slots through collision with the stripper and is thus intermediately stacked between the stacker wheel circumference and the guideway. If the stack deposit is ready for the accommodation of sheet material, the stripper is brought to a second position, whereby the intermediately stacked sheet material is stacked on the stack deposit. As long as the stripper remains in this second position the sheet material collides with the stripper in the stacker wheel in such a way that it is directly stacked on the stack deposit without intermediate stacking. Since the bank notes are usually continuously supplied to the individual slots of the stacker wheel, further bank notes can also be intermediately stacked during the rotation of the stripper from the first to the second position.

Such a spiral slot stacker can for example also be used as an intermediate repository in a bank note deposit apparatus in which the bank notes fed in during a deposit transaction are first intermediately stored subsequent to a verification, in order to be finally deposited and credited to the user's account in the case that the user agrees to the conclusion of the pending transaction, or to be returned to the user without credit entry in the case of the cancellation of the pending transaction.

However, the spiral slot stacker is particularly suitable for use in a bank note processing apparatus. The intermediate stacking of the sheet material enables the continuous stacking of sheets of a continuous flow of sheet material in predetermined or adjustable piece numbers, since the sheet material can be intermediately stacked between the stacker wheel circumference and the guideway for such a time until the stack deposit has been emptied and prepared for the accommodation of sheet material.

In a start position the guideway is preferably disposed at a small distance to the stacker wheel circumference. In the case that a great number of sheets is intermediately stacked between the guideway and the stacker wheel circumference, a jamming of the sheet material can occur during the stacking of the intermediately stacked sheet material due to the small distance. Therefore in a first embodiment at least a portion of the guideway is disposed displaceably from the stacker wheel circumference in order to increase the distance between the stacker wheel circumference and the guideway. This provides for a pushing out of the intermediately stacked sheet material onto the stack deposit without difficulty.

The guideway surrounds the stacker wheel preferably covering a great circumferential angle, e. g. covering approximately 180°, in order to provide for the reliable stacking also of lengthy sheet material. In the case that the guideway is provided as a single-piece component therein, the movement of the guideway does not bring about a uniform increase of distance. Therefore, the guideway can be divided into partial guideways, preferably into two partial guideways, each of which surrounding approximately 90° of the stacker wheel circumference. If the partial guideways are now moved away from the stacker wheel circumference in a direction radial in relation to the rotation axis, an essentially more uniform increase of the gap between the stacker wheel circumference and the guideway is achieved.

The movable guideway and the movable stripper preferably have a common drive. The drive for example comprises a stepping motor around whose axis a barrel cam for the movement of the guideway and a mover for the movement of the stripper are provided. Therein the barrel cam and the arrangement of the mover are adjusted to each other in such a manner that a suitable succession of movement, dependent on the angle of rotation, of the guideway and of the stripper is secured. In this way the method steps of increasing the distance by moving the guideway away from the stacker wheel and of pushing out the stacked bank notes by means of the stripper can be chronologically coordinated. The stripper is preferably mounted on the rotation axis of the stacker wheel and can be moved independently therefrom. The torque application for the stripper is carried out in the vicinity of the stacker wheel rotation axis by the mover. By the movement of the stripper independent from the stacker wheel it is possible to guide the movement of the latter independently from the flow of sheet material supplied to the stacker wheel and the units of an adjustable piece number of sheets.

In a further embodiment the spiral slot stacker has a second movable stripper. In a first position the second stacker engages with the stacker wheel in such a manner that it strips the sheet material off from the slots of the stacker wheel onto the stack deposit. In a second position, however, the second stripper is moved so far out of the stacker wheel that it does no longer take hold of the sheet material held in the stacker wheel. The outward movement of the second stripper out of the stacker wheel is correlated to the rotation speed of the stacker wheel in such a way that an $n^{th}$ sheet is neatly stripped off from the stacker wheel, whereas an $n+1^{th}$ sheet accommodated in the subsequent slot is just not taken hold of any more. The $n+1^{th}$ sheet then collides with the first stripper which is in its (first) intermediate stacking position. This sheet and the subsequent sheets are stripped off from the stacker wheel by colliding with the first stripper and are intermediately stacked between the stacker wheel circumference and the guideway. When the first stripper is moved to its second position, the intermediately stacked bank notes are pushed onto the stack deposit and stacked there, and also the bank notes in the stacker wheel are directly stacked on the stack deposit as long as the first stripper remains in this position. Now the second stripper can be moved back to its first position in which it strips off the sheet material from the slots onto the stack deposit, and then also the first stripper can be moved back to its first position. By the use of the second movable stripper it is above all possible to achieve a continuous stacking also at high speeds of the stacker wheel and of the sheet- material supply. In another further embodiment the stack deposit is provided as a lockable sheet material repository. Such a spiral slot stacker can be used in a bank note deposit apparatus. If for example, like in the already described deposit transaction, the user agrees to the conclusion of the pending transaction, the bank notes can be deposited in the lockable repository, e. g. a cash box, and can be credited to the user's account. By the use of the lockable repository the secure storage of the stacked bank notes can be guaranteed.

In an especially preferred embodiment of the invention the spiral slot stacker comprises a side edge guide for guiding the side edges of the sheet material accommodated in the stacker wheel. Especially at high speeds the sheet material often does not lie flush in the slots of the stacker wheel, for which reason a side edge guide is advantageous in order to align the side edges of the sheet material accommodated in the stacker wheel. The side edge guide is movable in an axial direction in order to enable the adaptation of the spiral slot stacker to the processing of sheet material of variable formats. Such an axially movable side edge guide can also be used advantageously in conventional spiral slot stackers, e. g. also in such stackers with fixed strippers.

As already described, the sheet material is intermediately stacked between the stacker wheel circumference and the guideway for such a time until the stack deposit is ready for the accommodation of sheet material, thus the sheet material stacked there has been removed. The spiral slot stacker has a removal device for the removal of the stack from the stack deposit. The removal device has a rake-shaped bottom to which the stack deposit is adapted in that it is also provided in a rake-like shape, so that the bottom of the removal device can be moved underneath the sheet material stacked on the stack deposit. During the removal of the sheet material, thus when the rake-shaped bottom of the removal device is moved underneath the sheet material, the bottom displaces a preferably provided rake-shaped panel which fills the gaps of the rake-shaped stack deposit at least partially in order to form the stack deposit surface together with the latter during the stacking of the sheet material.

The removed sheet material can then for example be deposited in a stack receptacle or in a box. To enable a reliable stripping-off of the sheet material into the stack receptacle, the stack receptacle comprises a side well which is adapted to the rake-shaped bottom of the removal device and which is also rake-shaped, through which the bottom can be moved in a combining manner in order to deposit the sheet material in the stack receptacle in this manner.

In one embodiment the removal device is provided as a gripper with an upper gripper portion and the rake-shaped bottom for gripping the sheet material stacked on the stack deposit. Therein, due to the axially variable side edge guide, the maximum depth of the upper gripper portion should not exceed the dimension of the narrowest sheet material to be stacked. Such a removal device can also be advantageously used in conventional spiral slot stackers, e.g. also in such with fixed strippers.

BRIEF DESCRIPTION OF THE DRAWINGS

Further characteristics and advantages of the invention will result from the following description of a variety of exemplary embodiments and alternative embodiments according to the invention in connection with the accompanying drawings. The figures are described as follows.

DETAILED DESCRIPTION OF VARIOUS EMBODIMENTS

Spiral slot stackers like those described hereinafter with reference to the attached drawings can for example be used in bank note processing apparatus.

Figure 1A:
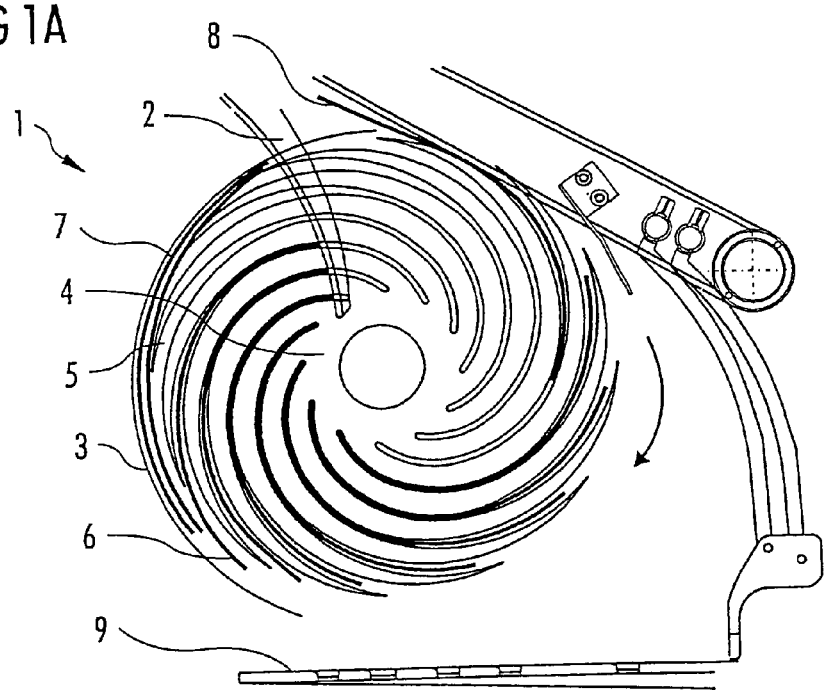
FIG. 1A a cross section of a spiral slot stacker with a stripper in a first position.
Figure 1B:
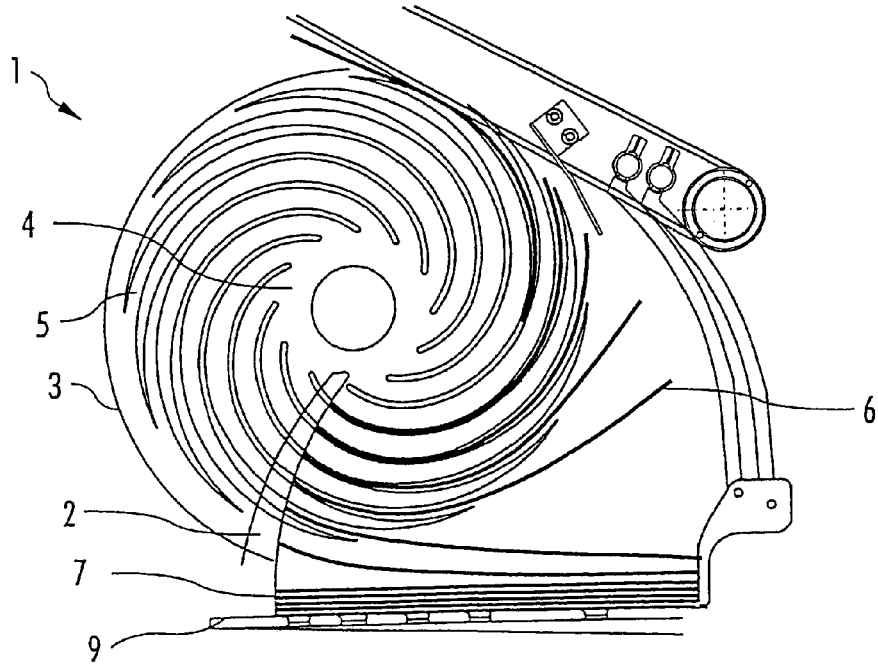
FIG. 1B the spiral slot stacker of FIG. 1A with the stripper in a second position.

In bank note processing apparatus bank notes are singled and supplied to the stacker successively. The slots of the stacker accommodating the bank notes are formed by stacker wheel fingers spirally disposed side by side around a rotation axis and spaced apart from each other, between which the stripper with stripping fingers suitably adapted and disposed side by side moves into engagement, in order to strip off the bank notes from the slots again. In FIGS. 1A and 1B the spiral slot stacker is shown in cross section, in such a way that merely one stripping finger as well as one stacker wheel finger plane are shown.

FIGS. 1A and 1B show a first exemplary embodiment of a spiral slot stacker 1 at different stages of the procedure. The spiral slot stacker has a stacker wheel 4 with slots 5 spirally disposed one behind the other around a rotation axis, in which bank notes 6, 7, 8 supplied to the spiral slot stacker 1 are accommodated. The rotating direction of the stacker wheel 4 is indicated by an arrow. FIG. 1A shows the spiral slot stacker 1 at the moment of supply of a bank note 8. A stripper 2 is in a first position, so that the bank notes 6 colliding with it are stripped off and intermediately stacked between the stacker wheel circumference and a guideway 3. In bank note processing apparatus the bank notes can for example be intermediately stacked for such a time until a stack deposit 9 is ready for the accommodation of the bank notes. For example in such apparatus bank notes are stacked in stacks of 100 bank notes each. When the one hundredth bank note is stacked on the stack deposit 9, the stacking process is interrupted for such a time or the bank notes are intermediately stacked for such a time until the stack deposit 9 has been emptied and is ready to accommodate the following bank notes.

FIG. 1B shows the spiral slot stacker 1 of FIG. 1A at a different stage of the procedure. The stripper 2 is now in a second position. By the movement from the first into the second position the intermediately stacked bank notes 7 are pushed onto the stack deposit 9 and are stacked there. All subsequent bank notes 6, which are accommodated in the stacker wheel 4, are not intermediately stacked, but are directly stacked on the stack deposit 9. In the above-mentioned example of the forming of a stack of 100 bank notes this would mean that the stripper 2 remains in its second position (FIG. 1B) for such a time until the one hundredth bank note has been stacked on stack deposit 9. Only then is the stripper 2 moved back to its first position, as is shown in FIG. 1A, to intermediately stack the bank notes until the stack of 100 bank notes has been removed from the stack deposit 9.

Figure 2A:
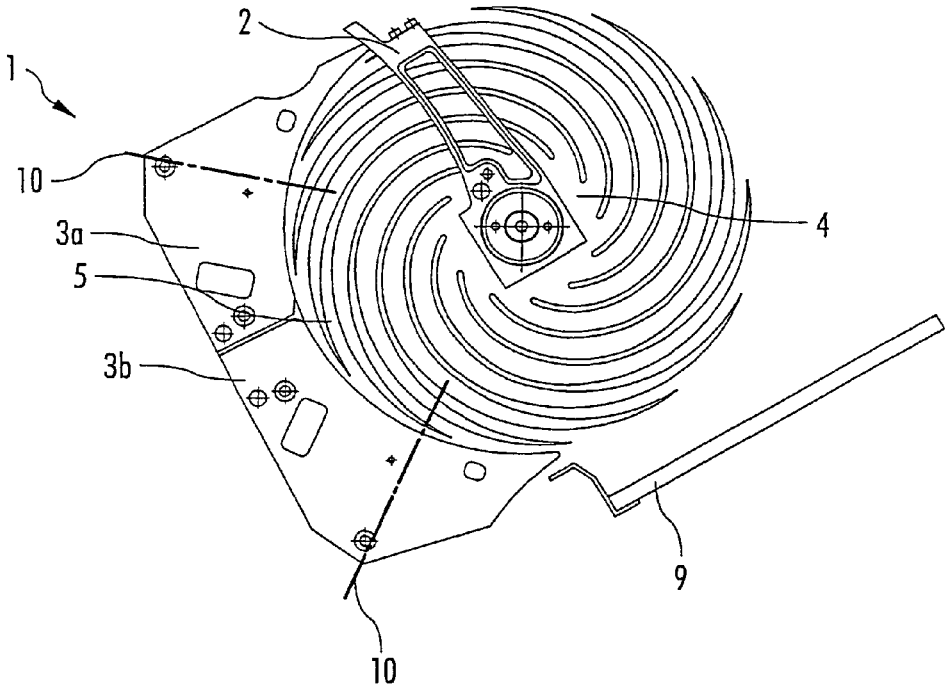
FIG. 2A a cross section of a spiral slot stacker with a guideway, which is divided into two partial guideways, and a stripper in a first position.

FIG. 2A shows a second exemplary embodiment of a spiral slot stacker 1 in cross section, with a stripper 2 in a first position and a guideway 3. The guideway 3 is divided into two movable partial guideways 3*a*, 3*b* here. The movement direction 10 of the partial guideways 3*a*, 3*b* is indicated by lines and corresponds to a radial direction in relation to the rotation axis of the stacker wheel 4. The guideway 3 shown in FIG. 2A surrounds approximately 180° of the stacker wheel circumference, wherein the partial guideways 3*a*, 3*b* each surround 90° of the stacker wheel circumference. The stripper 2 is in its first position, so that bank notes 6 colliding with it are intermediately stacked between the stacker wheel circumference and the guideway 3.

Figure 2B:
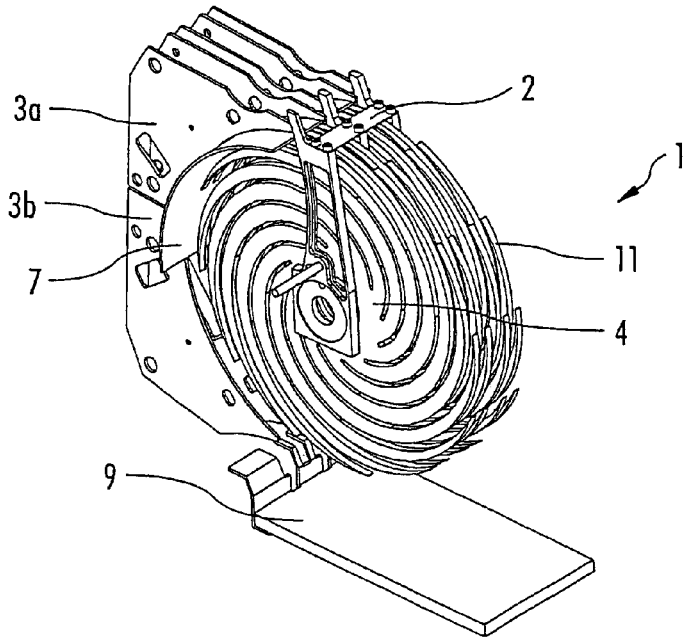
FIG. 2B a perspective view of the spiral slot stacker with a guideway, with a bank note between the spiral slot stacker circumference and the guideway.

FIG. 2B shows a perspective view of the spiral slot stacker 1 of FIG. 2A. The perspective view shows clearly that the slots 5 accommodating the bank notes are formed by stacker wheel fingers 11 arranged side by side and spaced apart from each other. Furthermore, it becomes clear that the stripper 2 is formed by stripper fingers disposed side by side, which engage between the stacker wheel fingers 11. In FIG. 2B an intermediately stacked bank note 7 is shown, which has collided with the stripper 2 and is therefore intermediately stacked between the stacker wheel circumference and the guideway 3.

Figure 2C:
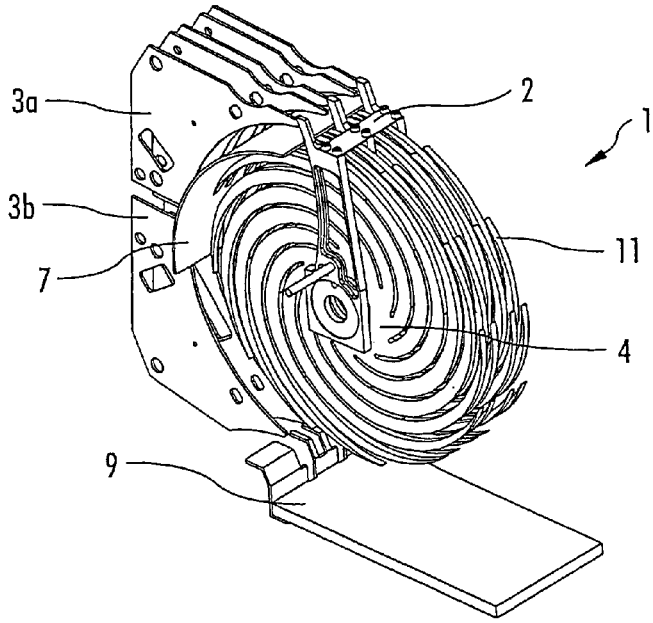
FIG. 2C the spiral slot stacker of FIG. 2B, wherein the partial guideways are moved away from the spiral slot stacker circumference.

In FIG. 2C a step subsequent to FIG. 2B is shown, in which the movable partial guideways 3*a*, 3*b* are moving away from the stacker wheel circumference in a direction radial in relation to the rotation axis of the stacker wheel 4. Thus a greater distance between the stacker wheel circumference and the guideway 3 is created, whereby the transport of the intermediately stacked bank notes 7 from the position of intermediate stacking to the stack deposit 9 is rendered more reliable, in particular in the case of a greater intermediate stack of a multitude of bank notes 7.

Figure 2D:
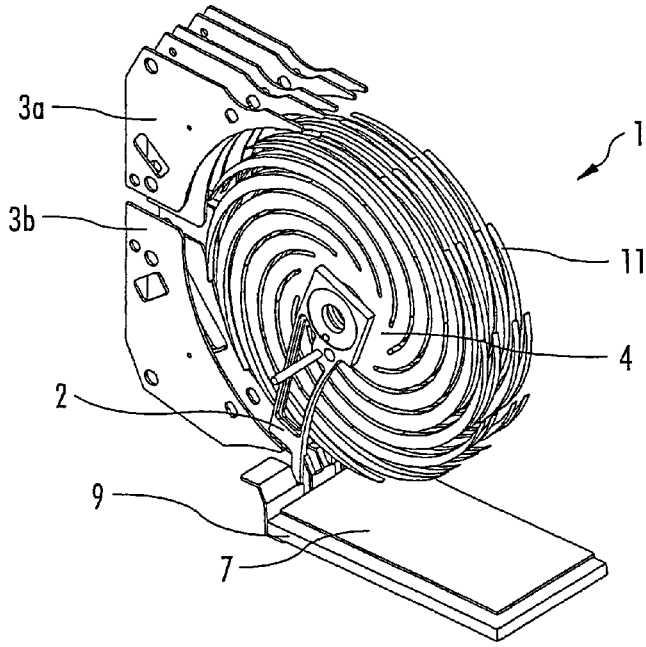
FIG. 2D the spiral slot stacker of FIG. 2C, wherein the stripper is in a second position and the bank note is stacked on a stack deposit.

FIG. 2D shows a step subsequent to FIG. 2C, in which the stripper 2 is in the second position, in which the intermediately stacked bank notes 7 are directly stacked on stack deposit 9. As already described in the first exemplary embodiment, also here all bank notes accommodated in the stacker wheel 4 are stacked directly on the stack deposit 9 until the stripper 2 is returned from its second position to its first position.

FIGS. 3A to 3D show a third exemplary embodiment of a spiral slot stacker 1 in cross section, which can in particular be used when bank notes 8 are supplied to the stacker wheel 4 at a high feed rate and the stacker wheel 4 turns at a correspondingly high speed. By furnishing the spiral slot stacker 1 in addition with a second stripper 12, a continuous stacking can be carried out even more reliably.

Figure 3A:
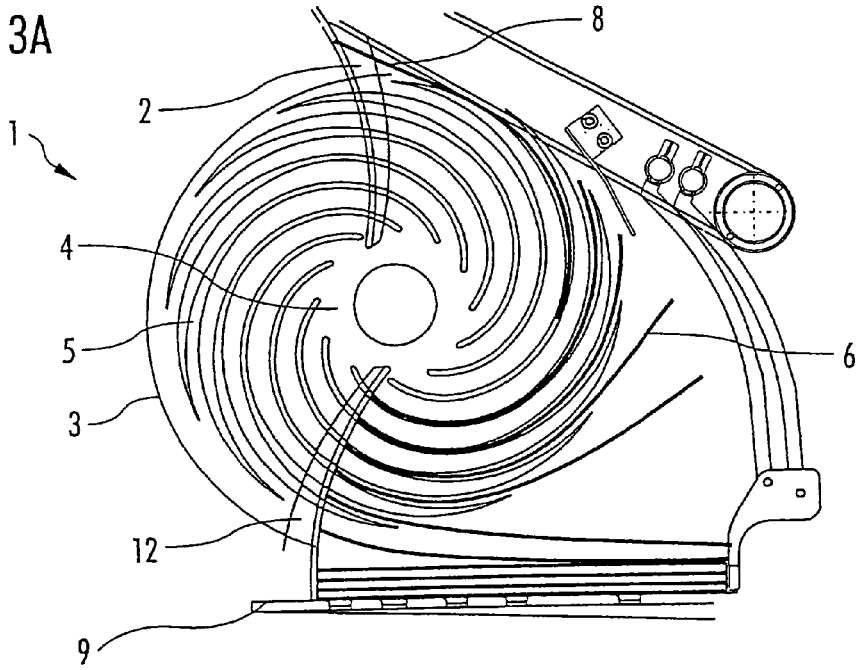
FIG. 3A a cross section of a spiral slot stacker with a first stripper, as shown in FIG. 1A, and a second stripper which is moved inside the stacker wheel.

In FIG. 3A the second stripper 12 in a first position engages with the stacker wheel 4 in such a manner that it stacks the bank notes 6 accommodated in the slots 5 of the stacker wheel 4 directly on the stack deposit 9 without intermediately stacking the bank notes 6. If, like in the above example, stacks of 100 bank notes each are to be formed on the stack deposit 9, the second stripper 12 remains in its first position for such a time until it has taken hold of the one hundredth bank note with its tip.

Figure 3B:
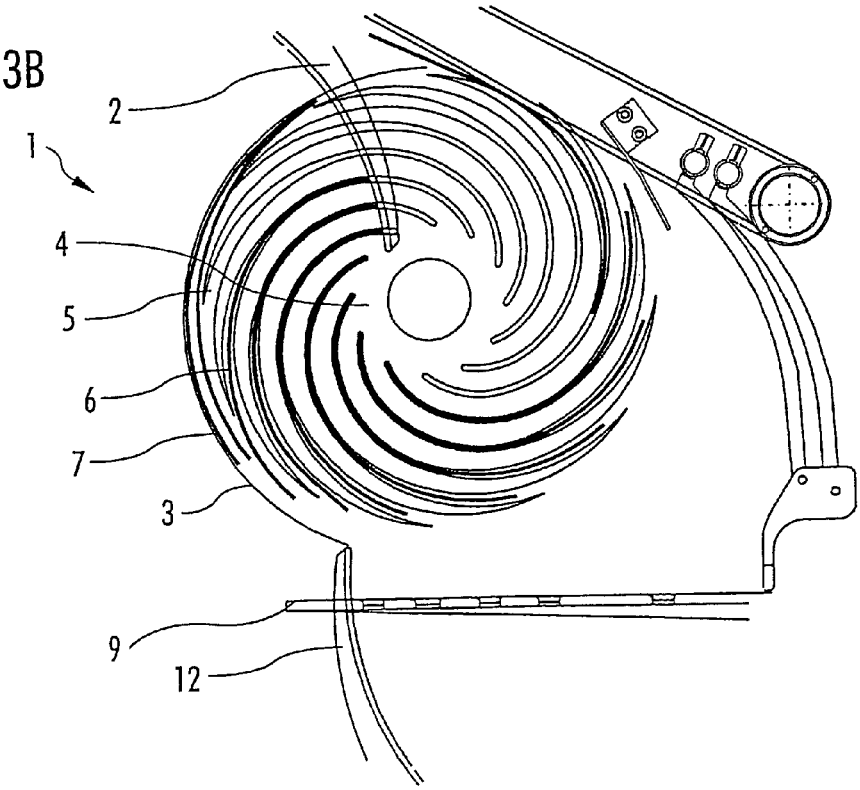
FIG. 3B the spiral slot stacker of FIG. 3A, wherein the second stripper is moved out of the spiral slot stacker.

As soon as it has collected the one hundredth bank note, the second stripper 12 is moved to a second position, so that it can no longer take hold of the bank notes accommodated in the subsequent slots 5 of the stacker wheel 4. The bank notes 6 then remain in the slots 5, as is shown in FIG. 3B, and collide with the first stripper 2 which is in its first, upper position. Therein, the first stripper 2 remains in its first position for such a time and the bank notes are intermediately stacked between the stacker wheel circumference and the guideway 3 for such a time until the stack of 100 bank notes has been removed from the stack deposit 9.

Figure 3C:
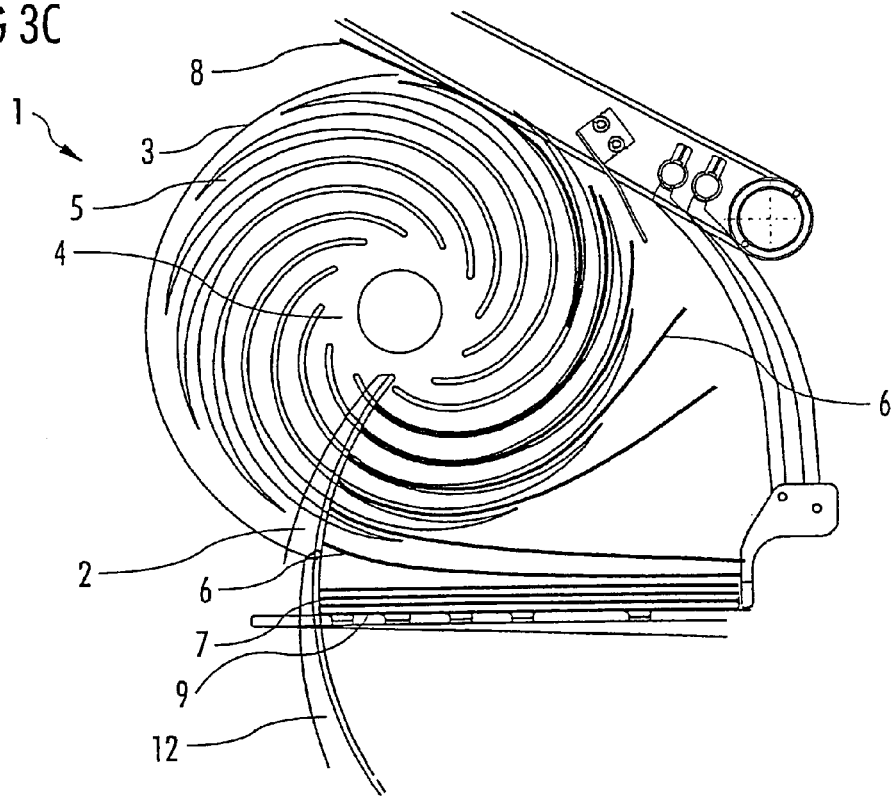
FIG. 3C the spiral slot stacker of FIG. 3B, wherein the first stripper is moved to its second position.

Subsequently, the first stripper 2, as is shown in FIG. 3C, is moved to its second, lower position, in order to push the intermediately stacked bank notes 7 onto the stack deposit 9. As long as the first stripper 2 remains in its second position, the bank notes 6 from the slots 5 of the stacker wheel 4 are directly stacked on the stack deposit 9.

Figure 3D:
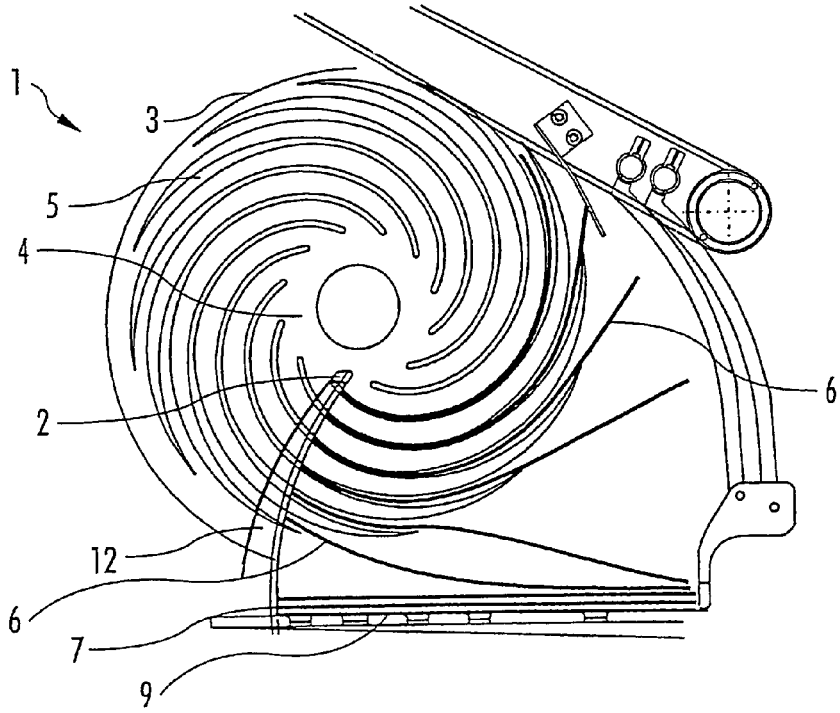
FIG. 3D the spiral slot stacker of FIG. 3C, wherein the second stripper is moved inside the stacker wheel and is arranged parallel to the first stripper.

When the first stripper 2 it in its second position, the second stripper 12 is returned to its first position, so that the first and the second stripper 12, as shown in FIG. 3D, are parallel to each other. Afterwards the first stripper 2 can be returned to its first, upper position (see FIG. 3A) without colliding with bank notes in the slots 5 of the stacker wheel 4, since the bank notes accommodated in the slots 5 are stacked directly on the stack deposit 9 by the second stripper 12 in its first position.

Figure 4A:
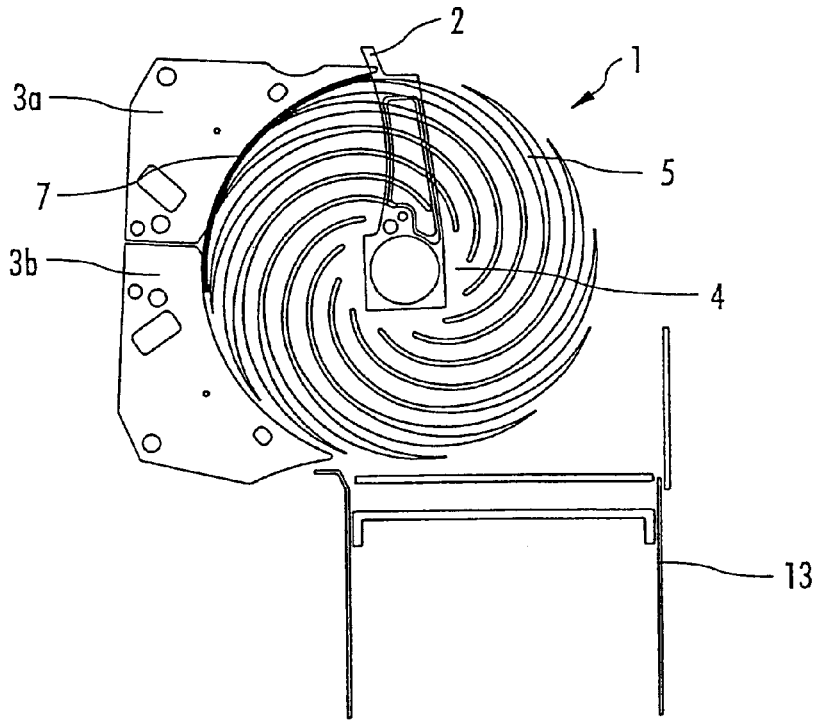
FIG. 4A a cross section of a spiral slot stacker with a locked sheet material repository.
Figure 4B:
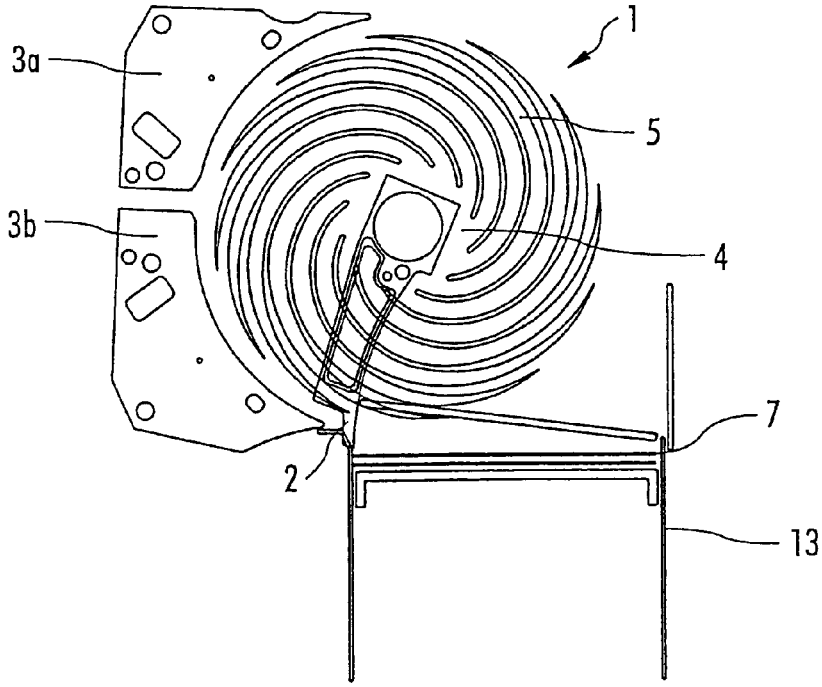
FIG. 4B the spiral slot stacker of FIG. 4A, wherein the sheet material repository is opened.

FIGS. 4A and 4B show a further exemplary embodiment of a spiral slot stacker 1 which is combinable with the exemplary embodiments described above. FIG. 4A shows the spiral slot stacker 1 with the stripper 2 in a first position and the guideway 3, wherein a bank note 7 is intermediately stacked between the guideway 3 and the stacker wheel circumference. The stack deposit 9 of the spiral slot stacker 1 is provided as a lockable sheet material repository 13 here, for example as a cash box. FIG. 4A shows the sheet material repository 13 in locked condition.

In this exemplary embodiment the bank notes 7 are intermediately stacked for such a time until the lock of the sheet material repository 13 has been opened in order to deposit the intermediately stacked bank notes 7 directly in the sheet material repository 13, as is shown in FIG. 4B, when the stripper 2 is moved to its second, lower position. Furthermore, it is shown in FIG. 4B that in the specifically illustrated embodiment here, the guideway 3 again consists of two movable partial guideways 3*a,* 3*b,* which are moved away from the stacker wheel circumference in a radial direction when the stripper 2 is moved from its first, upper position, to its second, lower position.

Figure 5:
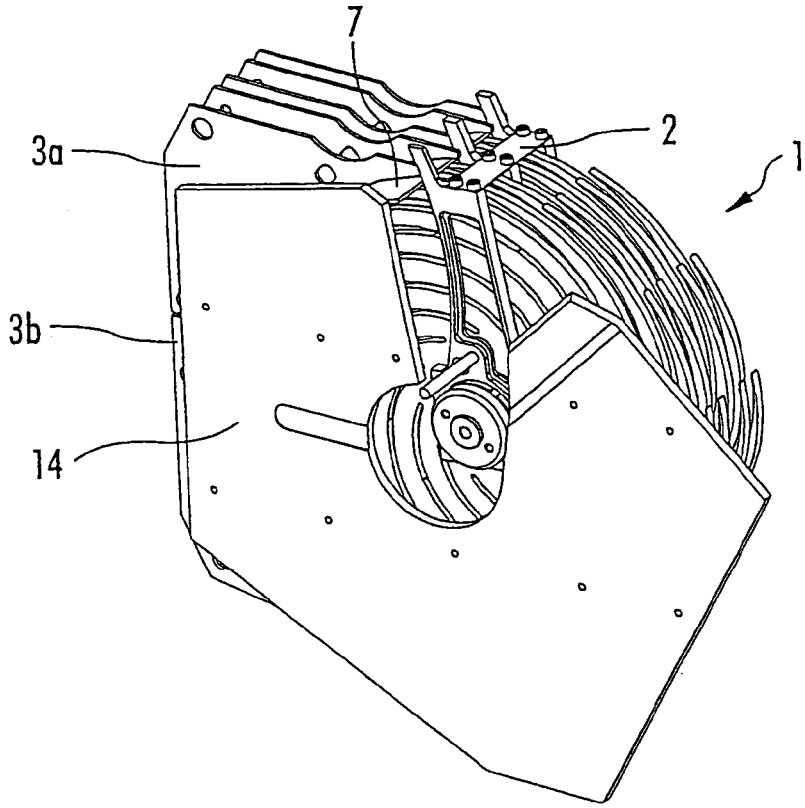
FIG. 5 a perspective view of a spiral slot stacker with side edge guide.

FIG. 5 shows a perspective view of a fifth exemplary embodiment, in which a spiral slot stacker 1, as is for example already described with reference to FIG. 2A, comprises a side edge guide 14 which is movable in an axial direction of the stacker wheel 4. The side edge guide 14 enables the flush alignment of bank notes 7 accommodated in the slots of the stacker wheel and intermediately stacked between the stacker wheel circumference and the guideway 3*a,* 3*b.* This is above all advantageous in the case of frequently changing bank note formats. The side edge guide 14 surrounds the stacker wheel by almost 360°, so that the bank notes 7 in the stacker wheel are aligned covering the overall planar side area of the stacker wheel. Favorably the effective surface of the side edge guide 14 covers the overall area of the stacker wheel slots which can contain bank notes during the operation procedure. The side edge guide 14 can be combined advantageously with any of the exemplary embodiments described above and also with conventional spiral slot stackers.

Figure 6:
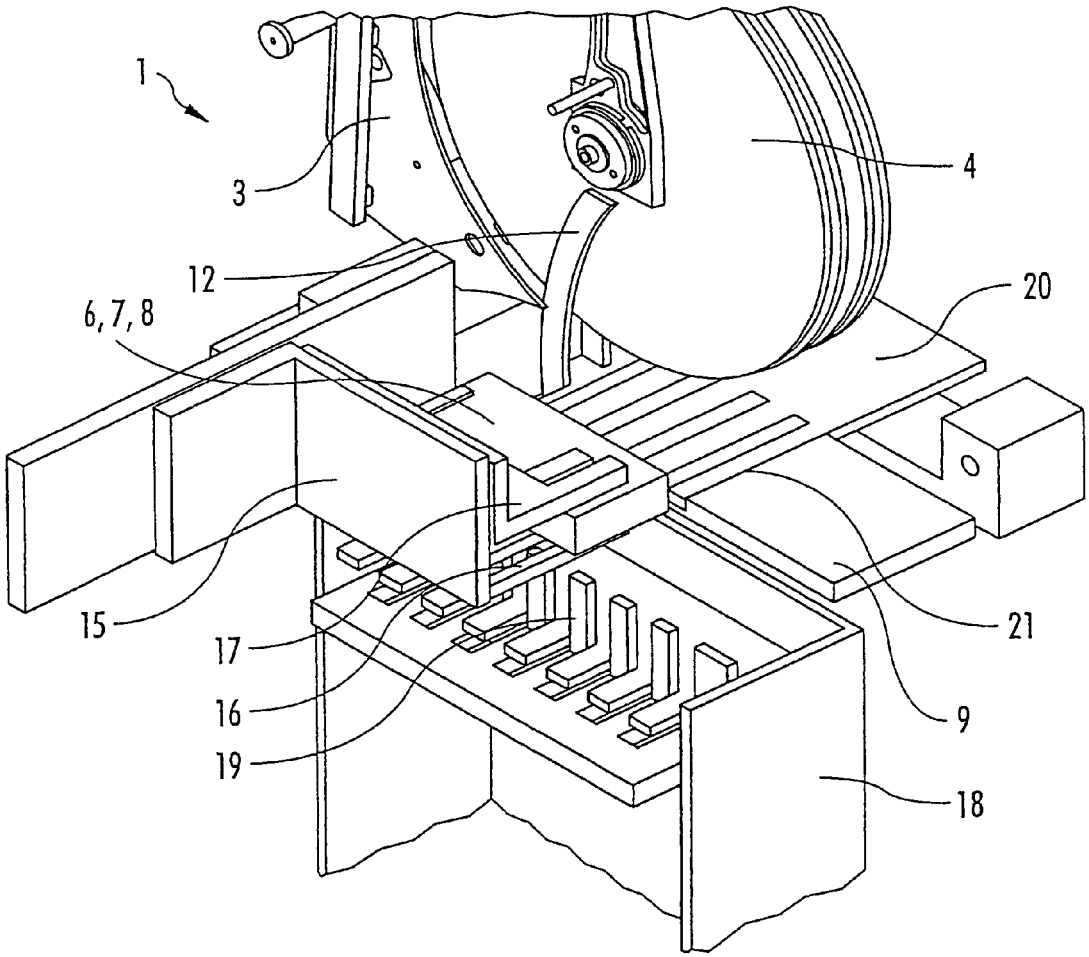
FIG. 6 a perspective view of a spiral slot stacker with a removal device.

FIG. 6 shows a perspective view of a sixth exemplary embodiment of a spiral slot stacker 1, as was in part described in the preceding exemplary embodiments. In order to enable a reliable stacking, in particular in the event that a predetermined piece number of bank notes 6, 7, 8 to be stacked on a stackdeposit 9 has to be reached, the stacked bank notes 6, 7, 8 have to be removed from the stack deposit 9. For this purpose, FIG. 6 shows the spiral slot stacker 1 with a removal device 15 with a rake-shaped bottom 16 for removing the bank notes 6, 7, 8 from the stack deposit 9. Therein, also the stack deposit 9 is rake-shaped and is adapted to the rake-shaped bottom in such a way that the bottom 16 can be moved underneath the bank notes 6, 7, 8 stacked on the stack deposit 9.

It can be seen in FIG. 6 that a rake-shaped panel 20 fills at least partially the gaps 21 of the stack deposit 9, which are adapted to the accommodation of the rake-shaped bottom 16 of the removal device 15. This panel 20 is pushed out of the gaps 21 of the stack deposit 9 when the removal device 15 is moved underneath the stack deposit 9. By the panel 20 filling the gaps 21 a stack surface is created which is planar across essentially the whole surface.

The removal device 15, as is shown in FIG. 6, is provided as a gripper and comprises in addition to the rake-shaped bottom 16 an upper gripper portion 17 to grip the bank notes 6, 7, 8 between the bottom 16 and the upper gripper portion 17. After the bank notes 6, 7, 8 stacked on the stack deposit 9 have been gripped by the gripper, they can be relocated to a stack receptacle 18 and stripped off there. For this purpose, a side wall 19 of the stack receptacle 18 is rake-shaped, so that the rake-shaped bottom 16 and the upper gripper portion 17 of the removal device 15 can be returned through the side wall 19, whereas the bank notes are retained in the stack receptacle 18. A safe deposit of the bank notes 6, 7, 8 in the stack receptacle 18 is thus secured. In order to avoid any contact of the upper gripper portion 17 with the stacker wheel 4 when it is disposed below the former during the removal of the bank notes 6, 7, 8, the tines of the upper gripper portion 17 are designed flatter and therefore lying lower in the vulnerable area. The removal device described above can also be used advantageously with conventional spiral slot stackers.

The invention claimed is:

1. Spiral slot stacker for stacking sheet material, comprising:

a stacker wheel with slots spirally disposed one behind the other around a rotation axis for receiving sheet material, a movable stripper, arranged to strip sheet material from the slots of the stacker wheel, the movable stripper arranged to move to first and second positions, and a stack deposit for stacking stripped-off sheet material, and a guideway at least partially surrounding the stacker wheel, wherein sheet material received in the slots are intermediately stacked between the stacker wheel circumference and the guideway by colliding with the stripper when the stripper is in the first position;

wherein the intermediately stacked sheet material is stacked onto the stack deposit when the stripper is moved to the second position.

2. Spiral slot stacker according to claim 1, wherein the sheet material received in the slots is directly stacked on the stack deposit by collision with the stripper in the second position.

3. Spiral slot stacker according to claim 1, wherein at least a part of the guideway is moveable away from the stacker wheel circumference.

4. Spiral slot stacker according to claim 3, wherein the guideway is divided into partial guideways.

5. Spiral slot stacker according to claim 3, wherein the guideway moves in a direction away from the stacker wheel circumference and in a direction which is radial in relation to the rotation axis.

6. Spiral slot stacker according to claim 3, wherein the guideway and the stripper have a common drive.

7. Spiral slot stacker according to claim 6, wherein the drive is a stepper motor, around the axis of which a barrel cam for the movement of the guideway and a mover for the movement of the stripper are provided, wherein the arrangement of the barrel cam and the arrangement of the mover is such that a succession of movements of the guideway and the stripper depending on the angle of rotation is enabled.

8. Spiral slot stacker according to claim 1, wherein the guideway surrounds approximately 180° of the stacker wheel circumference.

9. Spiral slot stacker according to claim 1, wherein the stripper is mounted on the rotation axis of the stacker wheel so as to be movable independently from the stacker wheel.

10. Spiral slot stacker according to claim 1, including a second movable stripper, which in a first position engages with the stacker wheel in such a way that it strips off the sheet material from the slots of the stacker wheel onto the stack deposit, and is movable out of the stacker wheel at least to such an extent into a second position that it does not take hold of the sheet material received in the stacker wheel.

11. Spiral slot stacker according to claim 1, wherein the stack deposit is configured as a lockable sheet material repository.

12. Spiral slot stacker for stacking sheet material, comprising:

a stacker wheel with slots spirally disposed one behind the other around a rotation axis for receiving sheet material, a stripper arranged to strip off sheet material from the slots of the stacker wheel, a stack deposit for stacking stripped-off sheet material, and a removal device with a rake-shaped bottom arranged to remove sheet material stacked on the stack deposit and to stack removed sheet material in a stack receptacle, wherein the stack deposit is rake-shaped and is adapted to cooperate with the rake-shaped bottom of the removal device in such a manner that the bottom is moveable underneath the sheet material stacked on the stack deposit;

wherein the stack receptacle comprises a rake-shaped side wall adapted to cooperate with the rake-shaped bottom of the removal device, through which the rake-shaped bottom of the removal device is moveable, to thereby enable the stripping off of the sheet material from the bottom into the stack receptacle.

13. Spiral slot stacker for stacking sheet material, comprising:

a stacker wheel with slots spirally disposed one behind the other around a rotation axis for receiving sheet material, a stripper arranged to strip off sheet material from the slots of the stacker wheel, a stack deposit for stacking stripped-off sheet material, and a removal device with a rake-shaped bottom arranged to remove sheet material stacked on the stack deposit and to stack removed sheet material in a stack receptacle, wherein the stack deposit is rake-shaped and is adapted to cooperate with the rake-shaped bottom of the removal device in such a manner that the bottom is moveable underneath the sheet material stacked on the stack deposit;

wherein the rake-shaped bottom of the removal device displaces, during its movement underneath the sheet material stacked on the stack depository, a rake-shaped panel which fills gaps of the rake-shaped stack deposit at least partially.

14. Spiral slot stacker for stacking sheet material, comprising:

a stacker wheel with slots spirally disposed one behind the other around a rotation axis for receiving sheet material, a stripper arranged to strip off sheet material from the slots of the stacker wheel, a stack deposit for stacking stripped-off sheet material, and a removal device with a rake-shaped bottom arranged to remove sheet material stacked on the stack deposit and to stack removed sheet material in a stack receptacle, wherein the stack deposit is rake-shaped and is adapted to cooperate with the rake-shaped bottom of the removal device in such a manner that the bottom is moveable underneath the sheet material stacked on the stack deposit;

wherein the removal device comprises a gripper with an upper gripper portion and said rake-shaped bottom for removing the sheet material stacked on the stack deposit is disposed between the upper gripper portion and the bottom.

15. Method for stacking sheet material by means of a spiral slot stacker with a stacker wheel which has slots spirally disposed one behind the other around a rotation axis for receiving sheet material, comprising the following steps:

supplying sheet material to the slots of the stacker wheel, turning the stacker wheel with the sheet material, stripping off the sheet material from the slots of the turning stacker wheel by means of a movable stripper, stacking the sheet material stripped off from the slot on a stack deposit, intermediately stacking the sheet material received in the slots between the stacker wheel circumference and a guideway surrounding the stacker wheel at least partially, by collision of the sheet material with the stripper when the stripper is in a first position; and stacking the sheet material intermediately stacked onto the stack deposit by moving the stripper to a second position.

16. Method according to claim 15, including the step of moving away at least a part of the guideway from the stacker wheel circumference to carry out the step of stacking.

17. Method according to claim 15, including the steps of stripping off the sheet material received in the slots onto the stack deposit by means of a second movable stripper, and, if the sheet material is to be intermediately stacked by means of the first stripper, moving the second stripper to a position in which it does not take hold of the sheet material received in the slots.

18. Method according to claim 15, including the step of taking hold of the sheet material stacked on the stack deposit by mans of a gripper and the subsequent step of stacking the sheet material in a stack receptacle.

* * * * *

UNITED STATES PATENT AND TRADEMARK OFFICE

CERTIFICATE OF CORRECTION

PATENT NO. : 7,624,983 B2
APPLICATION NO. : 11/596008
DATED : December 1, 2009
INVENTOR(S) : August Häusler It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 99 days.

Signed and Sealed this

Twenty-first Day of December, 2010

David J. Kappos

David J. Kappos
*Director of the United States Patent and Trademark Office*